US006941593B1

(12) United States Patent
Avidon

(10) Patent No.: US 6,941,593 B1
(45) Date of Patent: Sep. 13, 2005

(54) BATHTUB ASSISTANCE APPARATUS

(75) Inventor: Yakov Avidon, 1298 Hartford Turnpike #9G, North Haven, CT (US) 06473

(73) Assignee: Yakov Avidon, North Haven, CT (US)

( * ) Notice: Subject to any disclaimer, the term of this patent is extended or adjusted under 35 U.S.C. 154(b) by 0 days.

(21) Appl. No.: 10/719,240

(22) Filed: Nov. 21, 2003

(51) Int. Cl.[7] ..... A47K 3/022; A47K 3/024
(52) U.S. Cl. ..... 4/577.1
(58) Field of Search ..... 4/560.1, 571.1–579

(56) References Cited

U.S. PATENT DOCUMENTS 2,511,756 A 6/1950 Wallace
3,555,576 A 1/1971 Coakley
4,417,361 A 11/1983 Smith
4,520,515 A * 6/1985 Hatala ..... 4/579
5,341,525 A * 8/1994 Tillman et al. ..... 4/579
5,465,437 A * 11/1995 Herman ..... 4/611
5,887,297 A * 3/1999 Sutor ..... 4/578.1

* cited by examiner

*Primary Examiner*—Charles E. Phillips

(57) ABSTRACT

A bathtub assistance apparatus for aiding a user entering and exiting a bathtub. The bathtub assistance apparatus includes a frame assembly being designed for being positioned on top of the bathtub whereby the frame assembly extends between opposing walls positioned at opposite ends of the bathtub. A support assembly is coupled to the frame assembly whereby the support assembly extends upwardly from the frame assembly. The support assembly is designed for being gripped by the user to provide support for the user when the user is entering and exiting a bathtub. At least one locking member is operationally coupled to the frame assembly. The locking member is designed for selectively engaging the bathtub whereby the locking member inhibits sliding of the frame assembly with respect to the bathtub when the user uses the support assembly.

13 Claims, 4 Drawing Sheets

BATHTUB ASSISTANCE APPARATUS

BACKGROUND OF THE INVENTION

1. Field of the Invention

The present invention relates to bathtub handrails and more particularly pertains to a new bathtub assistance apparatus for aiding a user entering and exiting a bathtub.

2. Description of the Prior Art

The use of bathtub handrails is known in the prior art. U.S. Pat. No. 3,555,576 describes a system for handgrip for a user in a bathtub to pull against to assist the user. Another type of bathtub handrail is U.S. Pat. No. 2,511,756 having a handrail that is coupled to the bath tub to be gripped by the user to assist the user while in the bathtub. U.S. Pat. No. 4,417,361 has a gripping means being coupled to side wall of the bathtub to provide hand support for a person stepping over the wall of the bathtub.

While these devices fulfill their respective, particular objectives and requirements, the need remains for a device that has certain improved features ensures that the apparatus can not inadvertently move when being used by the user.

SUMMARY OF THE INVENTION

The present invention meets the needs presented above by providing extension members and a locking member used to inhibit horizontal movement of the apparatus and a spacer member to engage the ceiling to inhibit vertical movement of the apparatus.

Still yet another object of the present invention is to provide a new bathtub assistance apparatus that provides a user with multiple areas to grasp the apparatus to provide the best support for the user.

To this end, the present invention generally comprises a frame assembly being designed for being positioned on top of the bathtub whereby the frame assembly extends between opposing walls positioned at opposite ends of the bathtub. A support assembly is coupled to the frame assembly whereby the support assembly extends upwardly from the frame assembly. The support assembly is designed for being gripped by the user to provide support for the user when the user is entering and exiting a bathtub. At least one locking member is operationally coupled to the frame assembly. The locking member is designed for selectively engaging the bathtub whereby the locking member inhibits sliding of the frame assembly with respect to the bathtub when the user uses the support assembly.

The disabled community is estimated to be about eight percent of the U.S. population, a figure that includes people with physical impairments and mobility limitations and other issues. Elderly individuals, many of whom are disabled or suffer varying types of physical limitations, comprised 13 percent of the population in 2000. Individuals classified as elderly are all individuals who have attained the age of 65 or older. The elderly and physically impaired individuals are faced with many problems which cannot be envisioned by the majority of the populace who are fortunate enough to have all their physical faculties and facilities. Many routine, everyday tasks cannot be accomplished without assistance of another individual. One such task is bathing, a basic task which is essential for maintaining good hygiene and health. Lowering and raising themselves in a bathtub, without assistance, can be extremely difficult for the elderly and physically impaired and many bathtub related injuries are incurred each year. Having recognized the applicant has seen a need for an bathtub assistance apparatus that would make it possible for the elderly and impaired to take a bath without assistance, and safely enter and exit a bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
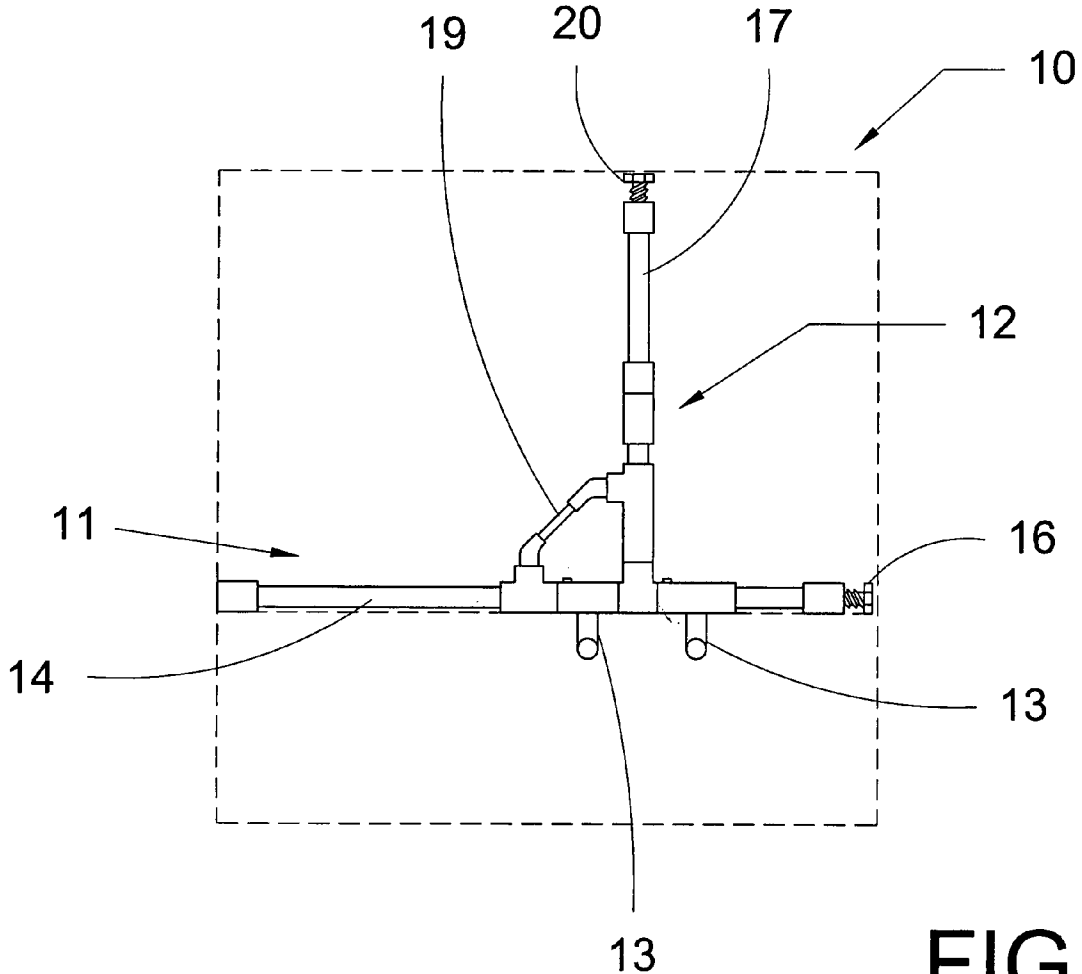
FIG. 1 is a side view of a new bathtub assistance apparatus according to the present invention shown in use.
Figure 2:
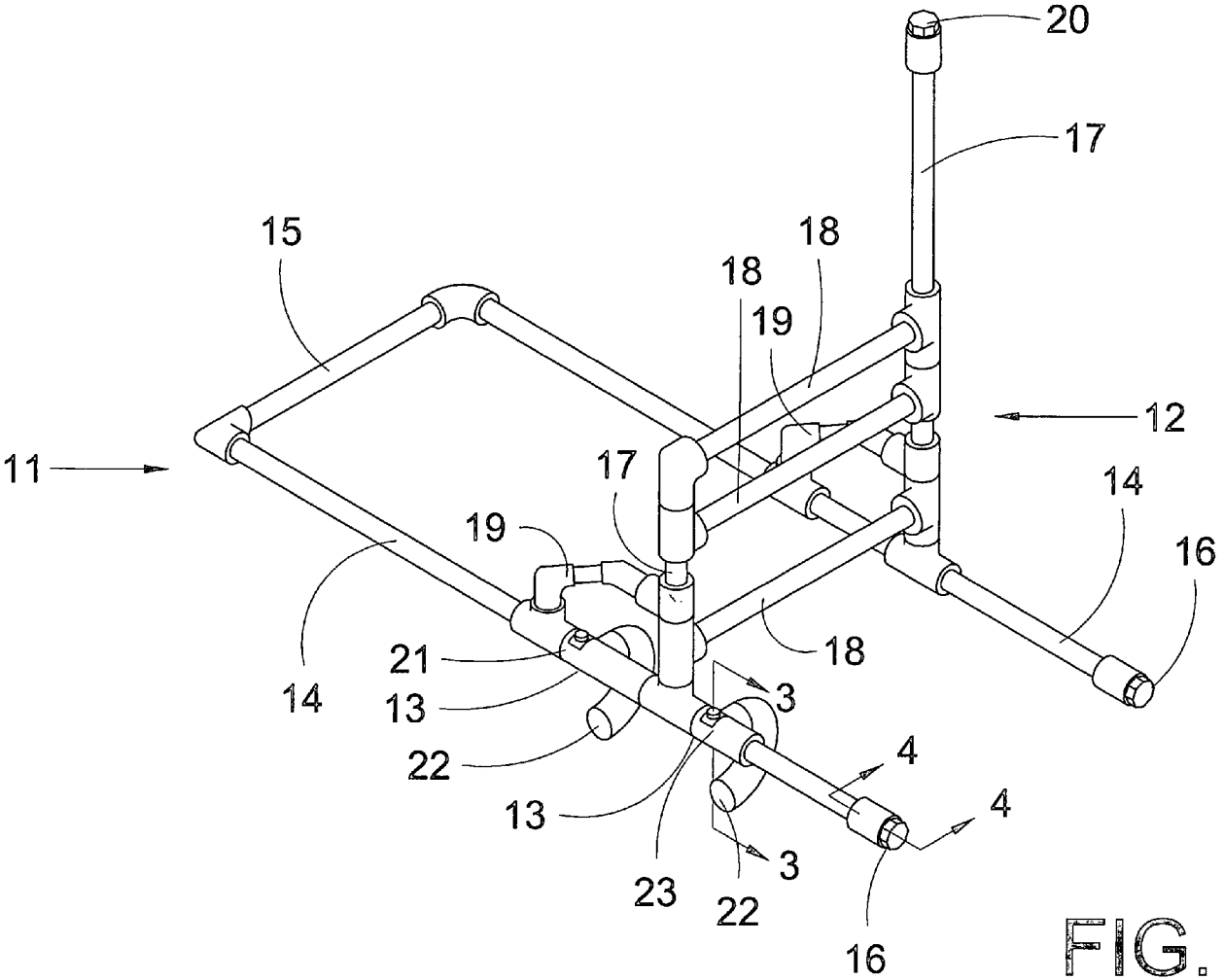
FIG. 2 is a Perspective view of the present invention.
Figure 3:
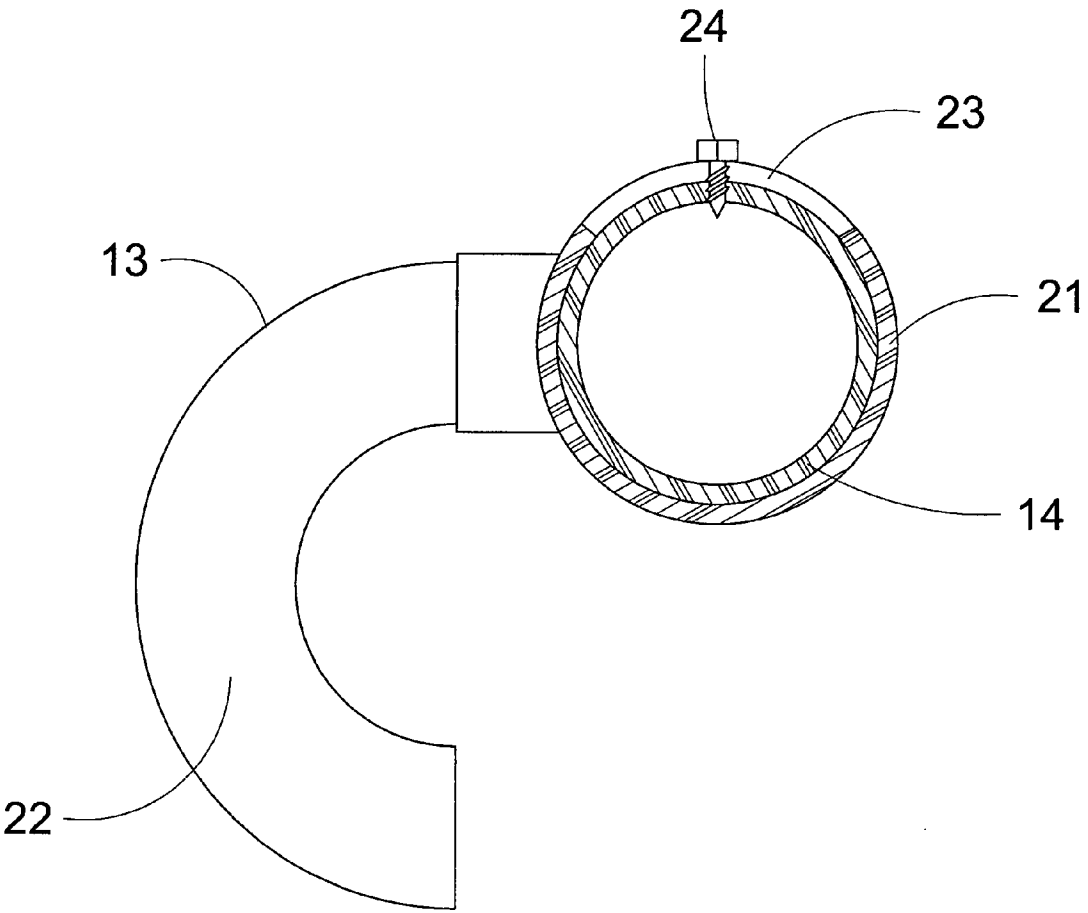
FIG. 3 is a cross-sectional view of the present invention taken along line 3—3 of FIG. 2.
Figure 4:
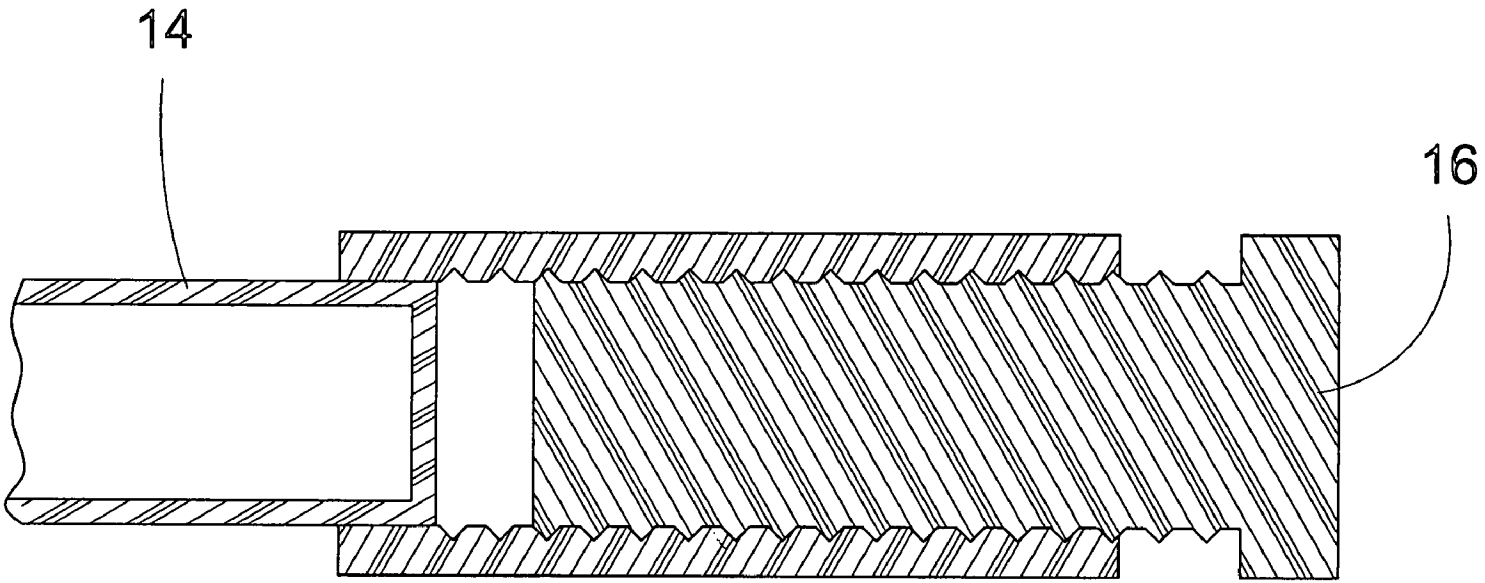
FIG. 4 is a cross-sectional view of the present invention taken along line 4—4 of FIG. 2.

With reference now to the drawings, and in particular to FIGS. 1 through 4 thereof, a new bathtub assistance apparatus embodying the principles and concepts of the present invention and generally designated by the reference numeral 10 will be described.

As best illustrated in FIGS. 1 through 4, the bathtub assistance apparatus 10 generally comprises a frame assembly 11 being designed for being positioned on top of the bathtub whereby the frame assembly 11 extends between opposing walls positioned at opposite ends of the bathtub.

A support assembly 12 is coupled to the frame assembly 11 whereby the support assembly 12 extends upwardly from the frame assembly 11. The support assembly 12 is designed for being gripped by the user to provide support for the user when the user is entering and exiting a bathtub.

At least one locking member 13 is operationally coupled to the frame assembly 11. The locking member 13 is designed for selectively engaging the bathtub whereby the locking member 13 inhibits sliding of the frame assembly 11 with respect to the bathtub when the user uses the support assembly 12.

The frame assembly 11 comprises a pair of side members 14 and an end member 15. The end member 15 is coupled to the side members 14 whereby the end member 15 extends between the side members 14. The end member 15 is positioned at an end of each of the side members 14 whereby the end member 15 is designed for being positioned adjacent one of the opposing walls. The side members 14 is designed for extending along the length of the bathtub.

The frame assembly 11 comprises pair of extension members 16. Each of the extension members 16 is operationally coupled to one of the side members 14 opposite the end member 15. Each of the extension members 16 is selectively extendable from the associated one of the side members 14 whereby the extension members 16 are designed for engaging one of the opposing walls to secure the frame assembly 11 between the opposing walls. Each of the extension members 16 is threadably coupled to the associated one of the side members 14 whereby the extension member are rotated to extend and retract the extension members 16 to fit the distance between the opposing walls.

The support assembly 12 comprises a pair of stanchion members 17 and at least one support member 18. Each of the stanchion members 17 is coupled to one of the side members 14 of the frame assembly 11 whereby each of the stanchion members 17 extends upwardly from the associated one of the side members 14 of the frame assembly 11 and the bathtub. The support member 18 is coupled to the stanchion members 17 whereby the support member 18 extends between the stanchion members 17. The support member 18 is designed for being grasped by the user to support the weight of the user when the user is entering and exiting a bath.

The support assembly 12 comprises a pair of bracing members 19. Each of the bracing members 19 is coupled to one of the stanchion members 17 and one of the side members 14 of the frame assembly 11 whereby each of the bracing members 19 extend between the associated one of the side members 14 of the frame assembly 11 and the associated one of the stanchion members 17. The bracing members 19 are for providing additional support for the stanchion members 17 when the user puts weight on the support member 18.

One of the stanchion members 17 has a length greater than a length of the other one of the stanchion members 17 whereby the one of the stanchion members 17 having the greater length is designed for extending between the frame assembly 11 and a ceiling above the bathtub. The one of the stanchion members 17 having the greater length is designed for abutting the ceiling to push the frame assembly 11 against the top of the bathtub.

The support assembly 12 comprises a spacer member 20. The spacer member 20 is operationally coupled to the one of the stanchion members 17 having the greater length opposite the frame assembly 11. The spacer member 20 is designed for abutting against the ceiling to compensate for a gap between the ceiling and the stanchion members 17 when the spacer member 20 is actuated with respect to the associated one of the stanchion members 17. The spacer member 20 is threadably coupled to the associated one of the stanchion members 17 whereby rotation of the spacer member 20 retracts and extends the spacer member 20 from the associated one of the stanchion members 17 to match the distance between the bathtub and the ceiling.

The locking member 13 comprises a pivot portion 21 and an engaging member 22. The pivot portion 21 is pivotally coupled to one of the side members 14 of the frame assembly 11. The engaging member 22 is coupled to the pivot portion 21 whereby the engaging member 22 pivots around the associated one of the side members 14 of the frame assembly 11. The engaging member 22 is designed for engaging a side of the bathtub to inhibit sliding of the frame assembly 11 with respect to the bathtub when the locking member 13 is pivoted with respect to the frame assembly 11.

The pivot portion 21 of the locking member 13 comprises a slot 23. The slot 23 extends through the pivot portion 21. The slot 23 of the pivot portion 21 receives a limiting member 24. The limiting member 24 is operationally coupled to the associated one of the side members 14 of the frame assembly 11 whereby the limiting member 24 is for limiting the amount the locking member 13 rotates with respect to the associated one of the side members 14 of the frame assembly 11. The limiting member 24 is selectively actuated to secure the sleeve portion against the associated one of the side members 14 of the frame assembly 11 to inhibit inadvertent rotation of the locking member 13 with respect to the frame assembly 11.

The frame assembly 11, the support assembly 12 and the locking member 13 are comprised of polyvinyl chloride pipes, elbows and tees to effect the structure. The polyvinyl chloride provides a high degree of strength while still being light and easy to manipulate by the user.

In use, the user places the frame assembly 11 on the top of the bathtub and rotates the extension members 16 to force the frame assembly 11 to engage both opposing walls. The spacer member 20 is then rotated with respect to the associated one of the stanchion members 17 to force the spacer member 20 against the ceiling and push the frame assembly 11 against the top of the bathtub. The user then rotates the locking member 13 down so that the engaging portion of the locking member 13 engages the inside side of the bathtub. The limiting member 24 is then tightened down to secure the pivot portion 21 to the associated one of the side members 14 to inhibit rotation of the locking member 13 with respect to the associated one of the side members 14. The engaging portion of the locking member 13 inhibits the frame assembly 11 from sliding along the top of the bathtub. The user then grasps at least one support member 18 to help with entering or exiting the bathtub to inhibit injury to the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathtub assistance apparatus for providing assistance for a user to inhibit the user falling when the user is entering and exiting the bathtub, the bathtub assistance apparatus comprising:

a frame assembly being adapted for being positioned on top of the bathtub such that said frame assembly extends between opposing walls positioned at opposite ends of the bathtub;

a support assembly being coupled to said frame assembly such that said support assembly extends upwardly from said frame assembly, said support assembly being adapted for being gripped by the user to provide support for the user when the user is entering and exiting a bathtub;

at least one locking member being operationally coupled to said frame assembly, said locking member being adapted for selectively engaging the bathtub such that said locking member inhibits sliding of said frame assembly with respect to the bathtub when the user uses said support assembly; and said support assembly comprising a pair of stanchion members and at least one support member, each of said stanchion members being coupled to said frame assembly such that each of said stanchion members extends upwardly from said frame assembly and the bathtub, said support member being coupled to said stanchion members such that said support member extends between said stanchion members, said support member being adapted for being grasped by the user to support the weight of the user when the user is entering and exiting a bath.

2. The bathtub assistance apparatus as set forth in claim 1, further comprising:

said frame assembly comprising a pair of side members and an end member, said end member being coupled to said side members such that said end member extends between said side members, said end member being positioned at an end of each of said side members such that said end member is adapted for being positioned adjacent one of the opposing walls, said side members being adapted for extending along the length of the bathtub.

3. The bathtub assistance apparatus as set forth in claim 2, further comprising:

said frame assembly comprising pair of extension members, each of said extension members being operationally coupled to one of said side members opposite said end member, each of said extension members being selectively extendable from the associated one of said side members such that said extension members are adapted for engaging one of the opposing walls to secure said frame assembly between the opposing walls.

4. The bathtub assistance apparatus as set forth in claim 1, further comprising:

said support assembly comprising a pair of bracing members, each of said bracing members being coupled to one of said stanchion members and said frame assembly such that each of said bracing members extend between said frame assembly and the associated one of said stanchion members, said bracing members being for providing additional support for said stanchion members when the user puts weight on said support member.

5. The bathtub assistance apparatus as set forth in claim 1, further comprising:

one of said stanchion members having a length greater than a length of the other one of said stanchion members such that the one of said stanchion members having the greater length is adapted for extending between said frame assembly and a ceiling above the bathtub, the one of said stanchion members having the greater length being adapted for abutting the ceiling to push said frame assembly against the top of the bathtub.

6. The bathtub assistance apparatus as set forth in claim 5, further comprising:

said support assembly comprising a spacer member, said spacer member being operationally coupled to the one of said stanchion members having the greater length opposite said frame assembly, said spacer member being adapted for abutting against the ceiling to compensate for a gap between the ceiling and the stanchion members when said spacer member is actuated with respect to the associated one of said stanchion members.

7. The bathtub assistance apparatus as set forth in claim 1, further comprising:

said locking member comprising a pivot portion and an engaging member, said pivot portion being pivotally coupled to said frame assembly, said engaging member being coupled to said pivot portion such that said engaging member pivots around said frame assembly, said engaging member being adapted for engaging a side of the bathtub to inhibit sliding of said frame assembly with respect to the bathtub when said locking member is pivoted with respect to the frame assembly.

8. The bathtub assistance apparatus as set forth in claim 7, further comprising:

said pivot portion of said locking member comprising a slot, said slot extending through said pivot portion, said slot of said pivot portion receiving a limiting member, said limiting member being operationally coupled to said frame assembly such that said limiting member is for limiting the amount said locking member rotates with respect to said frame assembly, said limiting member being selectively actuated to secure said sleeve portion against said frame assembly to inhibit inadvertent rotation of said locking member with respect to said frame assembly.

9. A bathtub assistance apparatus for providing assistance for a user to inhibit the user falling when the user is entering and exiting the bathtub, the bathtub assistance apparatus comprising:

a frame assembly being adapted for being positioned on top of the bathtub such that said frame assembly extends between opposing walls positioned at opposite ends of the bathtub;

a support assembly being coupled to said frame assembly such that said support assembly extends upwardly from said frame assembly, said support assembly being adapted for being gripped by the user to provide support for the user when the user is entering and exiting a bathtub;

at least one locking member being operationally coupled to said frame assembly, said locking member being adapted for selectively engaging the bathtub such that said locking member inhibits sliding of said frame assembly with respect to the bathtub when the user uses said support assembly;

said frame assembly comprising a pair of side members and an end member, said end member being coupled to said side members such that said end member extends between said side members, said end member being positioned at an end of each of said side members such that said end member is adapted for being positioned adjacent one of the opposing walls, said side members being adapted for extending along the length of the bathtub;

said frame assembly comprising pair of extension members, each of said extension members being operationally coupled to one of said side members opposite said end member, each of said extension members being selectively extendable from the associated one of said side members such that said extension members are adapted for engaging one of the opposing walls to secure said frame assembly between the opposing walls;

said support assembly comprising a pair of stanchion members and at least one support member, each of said stanchion members being coupled to one of said side members of said frame assembly such that each of said stanchion members extends upwardly from the associated one of said side members of said frame assembly and the bathtub, said support member being coupled to said stanchion members such that said support member extends between said stanchion members, said support member being adapted for being grasped by the user to support the weight of the user when the user is entering and exiting a bath;

said support assembly comprising a pair of bracing members, each of said bracing members being coupled to-one of said stanchion members and one of said side members of said frame assembly such that each of said bracing members extend between the associated one of said side members of said frame assembly and the associated one of said stanchion members, said bracing members being for providing additional support for said stanchion members when the user puts weight on said support member;

one of said stanchion members having a length greater than a length of the other one of said stanchion members such that the one of said stanchion members having the greater length is adapted for extending between said frame assembly and a ceiling above the bathtub, the one of said stanchion members having the greater length being adapted for abutting the ceiling to push said frame assembly against the top of the bathtub;

said support assembly comprising a spacer member, said spacer member being operationally coupled to the one of said stanchion members having the greater length opposite said frame assembly, said spacer member being adapted for abutting against the ceiling to compensate for a gap between the ceiling and the stanchion members when said spacer member is actuated with respect to the associated one of said stanchion members;

said locking member comprising a pivot portion and an engaging member, said pivot portion being pivotally coupled to one of said side members of said frame assembly, said engaging member being coupled to said pivot portion such that said engaging member pivots around the associated one of said side members of said frame assembly, said engaging member being adapted for engaging a side of the bathtub to inhibit sliding of said frame assembly with respect to the bathtub when said locking member is pivoted with respect to the frame assembly; and said pivot portion of said locking member comprising a slot, said slot extending through said pivot portion, said slot of said pivot portion receiving a limiting member, said limiting member being operationally coupled to the associated one of said side members of said frame assembly such that said limiting member is for limiting the amount said locking member rotates with respect to the associated one of said side members of said frame assembly, said limiting member being selectively actuated to secure said sleeve portion against the associated one of said side members of said frame assembly to inhibit inadvertent rotation of said locking member with respect to said frame assembly.

10. A bathtub assistance apparatus for providing assistance for a user to inhibit the user falling when the user is entering and exiting the bathtub, the bathtub assistance apparatus comprising:

a frame assembly being adapted for being positioned on top of the bathtub such that said frame assembly extends between opposing walls positioned at opposite ends of the bathtub;

a support assembly being coupled to said frame assembly such that said support assembly extends upwardly from said frame assembly, said support assembly being adapted for being gripped by the user to provide support for the user when the user is entering and exiting a bathtub;

at least one locking member being operationally coupled to said frame assembly, said locking member being adapted for selectively engaging the bathtub such that said locking member inhibits sliding of said frame assembly with respect to the bathtub when the user uses said support assembly; and said locking member comprising a pivot portion and an engaging member, said pivot portion being pivotally coupled to said frame assembly, said engaging member being coupled to said pivot portion such that said engaging member pivots around said frame assembly, said engaging member being adapted for engaging a side of the bathtub to inhibit sliding of said frame assembly with respect to the bathtub when said locking member is pivoted with respect to the frame assembly.

11. The bathtub assistance apparatus as set forth in claim 10, further comprising:

said frame assembly comprising a pair of side members and an end member, said end member being coupled to said side members such that said end member extends between said side members, said end member being positioned at an end of each of said side members such that said end member is adapted for being positioned adjacent one of the opposing walls, said side members being adapted for extending along the length of the bathtub.

12. The bathtub assistance apparatus as set forth in claim 11, further comprising:

said frame assembly comprising pair of extension members, each of said extension members being operationally coupled to one of said side members opposite said end member, each of said extension members being selectively extendable from the associated one of said side members such that said extension members are adapted for engaging one of the opposing walls to secure said frame assembly between the opposing walls.

13. The bathtub assistance apparatus as set forth in claim 10, further comprising:

said pivot portion of said locking member comprising a slot, said slot extending through said pivot portion, said slot of said pivot portion receiving a limiting member, said limiting member being operationally coupled to said frame assembly such that said limiting member is for limiting the amount said locking member rotates with respect to said frame assembly, said limiting member being selectively actuated to secure said sleeve portion against said frame assembly to inhibit inadvertent rotation of said locking member with respect to said frame assembly.

* * * * *